US009368909B2

(12) United States Patent
Yagi et al.

(10) Patent No.: US 9,368,909 B2
(45) Date of Patent: Jun. 14, 2016

(54) ELECTRIC CONNECTOR

(71) Applicant: DAI-ICHI SEIKO CO., LTD., Kyoto (JP)

(72) Inventors: Sakai Yagi, Shizuoka (JP); Jun Mukunoki, Shizuoka (JP); Daisuke Matsushita, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/681,932

(22) Filed: Apr. 8, 2015

(65) Prior Publication Data

US 2015/0311629 A1 Oct. 29, 2015

(30) Foreign Application Priority Data

Apr. 25, 2014 (JP) ..... 2014-091516

(51) Int. Cl.
*H01R 13/62* (2006.01)
*H01R 13/627* (2006.01)
*H01R 13/631* (2006.01)

(52) U.S. Cl.
CPC ..... *H01R 13/6272* (2013.01); *H01R 13/631* (2013.01)

(58) Field of Classification Search
CPC ..... H01R 13/6272
USPC ..... 439/350–354, 357, 358
See application file for complete search history.

(56) References Cited

U.S. PATENT DOCUMENTS 5,507,666 A * 4/1996 Yamanashi ..... H01R 13/641 439/354
5,643,003 A * 7/1997 Myer ..... H01R 13/641 439/352
5,934,944 A * 8/1999 Aoyama ..... H01R 13/514 439/701
5,980,297 A * 11/1999 Sugie ..... H01R 13/6272 439/353
6,116,939 A * 9/2000 Fukuda ..... H01R 13/6272 439/354
6,129,574 A * 10/2000 Okayasu ..... H01R 4/2433 439/404
6,129,593 A * 10/2000 Aoyama ..... H01R 13/514 439/354
6,261,116 B1 * 7/2001 Ceru ..... H01R 13/6272 439/352
6,319,043 B1 * 11/2001 Takatsuki ..... H01R 13/6272 439/354
6,341,975 B1 * 1/2002 Takatsuki ..... H01R 13/6272 439/358
6,435,895 B1 * 8/2002 Fink ..... H01R 13/6272 439/352

(Continued)

FOREIGN PATENT DOCUMENTS

JP 2005135751 5/2005 ..... H01R 13/639
JP 2005317349 11/2005 ..... H01R 13/46
JP 2013030323 2/2013 ..... H01R 13/639

*Primary Examiner* — Ross Gushi
(74) *Attorney, Agent, or Firm* — Hayes Soloway P.C.

(57) ABSTRACT

An electric connector includes a first connector including a first housing in which an inner space is formed, and a second connector including a second housing insertable into the inner space, the first housing including in the inner space a lock engagement portion, the second housing including a lock arm having a lock projection to be engaged with the lock engagement portion, the first housing including in the inner space at least one rib extending in a first direction in which the second housing is inserted into the inner space, the lock arm being formed with a guide space into which the rib is able to be inserted when the second housing is inserted into the inner space.

10 Claims, 14 Drawing Sheets

(56) References Cited

U.S. PATENT DOCUMENTS 6,837,751 B2 * 1/2005 Vanden Wymelenberg ..... H01R 43/28 439/347
7,104,829 B2 * 9/2006 Volpone ..... H01R 13/6272 439/358
7,160,136 B2 * 1/2007 Zhang ..... H01R 13/6272 439/354
7,214,085 B2 * 5/2007 Ohtaka ..... H01R 13/6273 439/352
7,682,180 B2 * 3/2010 Brown ..... H01R 13/4223 439/352
7,785,130 B2 * 8/2010 Chen ..... H01R 13/6271 439/354
7,909,638 B2 * 3/2011 Seo ..... H01R 13/6272 439/352
7,972,163 B2 * 7/2011 Chen ..... H01R 13/6275 439/350
8,083,535 B2 * 12/2011 Chang ..... H01R 13/6272 439/357
8,210,864 B1 * 7/2012 Hernandez ..... H01R 13/4362 439/352
8,523,598 B2 * 9/2013 Wu ..... H01R 13/6275 439/352
8,920,186 B2 * 12/2014 Shishikura ..... H01R 13/436 439/352
8,986,037 B2 * 3/2015 Boemmel ..... H01R 13/4361 439/357
9,160,095 B2 * 10/2015 Littek ..... H01R 13/422 439/162
2004/0023547 A1 * 2/2004 Oka ..... H01R 13/6272 439/352
2006/0110969 A1 * 5/2006 Wu ..... H01R 13/4367 439/352
2009/0035980 A1 * 2/2009 Nakamura ..... H01R 13/641 439/352
2012/0164866 A1 6/2012 Suemitsu et al. ..... 439/345
2013/0029516 A1 1/2013 Miyawaki ..... 439/352
2014/0179146 A1 * 6/2014 Hamai ..... H01R 13/639 439/357
2015/0311629 A1 * 10/2015 Yagi ..... H01R 13/6272 439/345
2015/0333433 A1 * 11/2015 Yagi ..... H01R 13/514 439/701

* cited by examiner

ELECTRIC CONNECTOR

BACKGROUND OF THE INVENTION

1. Field of the Invention

The invention relates to an electric connector to be used for electrical connection between devices equipped in an automobile or various industrial machines, and specifically, to an electric connector including a lock arm equipped in an electric connector to connect the electric connector to another electric connector.

2. Description of the Related Art

Japanese Patent Application Publication No. 2005-135751 discloses an electric connector including a lock arm, a releasing unit formed at a rear end of the lock arm, and a flexible support portion formed between the lock arm and an upper surface of a female housing to extend in a front-rear direction. In the electric connector, the lock arm is connected to the support portion at a location closer to a front end than a rear end of the support portion, ensuring that the lock arm and the support portion can be arranged in a small space above an upper surface of the female housing in comparison with an electric connector having a lock arm connected to a support portion at a location closer to a rear end than a front end of the support portion, and thus, the female connector can be downsized.

Japanese Patent Application Publication No. 2013-30323 discloses an electric connector including a lock arm, an engagement hook to be engaged with an engagement hole formed at a connector housing when the electric connector is inserted into the connector housing, and a lock-releasing unit for releasing the engagement hook from the engagement hole when the lock arm is pushed towards a rear of the connector housing beyond the engagement hook, a fulcrum located closer to a rear end being positioned closer to the engagement hook than a fulcrum located closer to a front end in a direction opposite to a direction in which the engagement hook extends.

FIG. 13 illustrates an example of an inner housing of a conventional electric connector including a lock arm, and FIG. 14 illustrates an example of an outer housing into which the inner housing is inserted.

As illustrated in FIG. 13, a lock arm 51 is formed above an upper surface of an inner housing 50. As illustrated in FIG. 14, an outer housing 40 includes a hood 41 having a rectangular cross-section, into which the inner housing 50 is inserted. The hood 41 includes on an inner surface of an upper wall a recess 42 into which the lock arm 51 of the inner housing 50 is inserted. A plurality of metallic terminals 43 (see FIG. 16) extend in the hood 41 in a direction in which the inner housing 50 is inserted into the outer housing 40.

The lock arm 51 of the inner housing 50 includes a lock arm body 52, a front leg 53 supporting a front end of the lock arm body 52 on an upper surface of the inner housing 50, a rear leg 54 supporting a rear end of the lock arm body 52 on the upper surface of the inner housing 50, a lock projection 55 to be locked with a lock unit (not illustrated) located in the recess 42 formed at the hood 41 of the outer housing 40, and a releasing unit 56 for releasing the lock projection 55 from the lock unit.

As illustrated in FIG. 14, an electric connector including the hood 41 having a relatively great width of an opening is accompanied with a problem in that if the lock projection 55 has a relatively small width, the inner housing 50 is readily inclined relative to the outer housing 40 when cables connected to metallic terminals inserted into the inner housing 50 are pulled. Thus, the lock projection 55 may be designed to have a relatively great width in order to avoid the problem.

As illustrated in FIG. 15, the lock projection 55 designed to have a width WB greater than an initial width WA outwardly transfers a point at which the inner housing 50 starts inclining with the result that the inclination of the inner housing 50 is made smaller. However, the lock projection 55 having the greater width WB causes a problem in that if the inner housing 50 is inserted in an inclined condition into the outer housing 40, as illustrated in FIG. 16, the inner housing 50 may be inserted deeply into the outer housing 40, resulting in that the inner housing 50 makes contact with the metallic terminals 43 extending in the inner housing 40 to thereby cause the metallic terminals 43 to be bent and/or damaged.

SUMMARY OF THE INVENTION

In view of the above-mentioned problem in the conventional electric connector, it is an object of the present invention to provide an electric connector capable of preventing an inner housing from being deeply inserted in an inclined condition into an outer housing when the inner housing is inserted into the outer housing.

In one aspect of the present invention, there is provided an electric connector including a first connector including a first housing in which an inner space is formed, and a second connector including a second housing insertable into the inner space, the first housing including in the inner space with a lock engagement portion, the second housing including a lock arm having a lock projection to be engaged with the lock engagement portion, the first housing including in the inner space at least one rib extending in a first direction in which the second housing is inserted into the inner space, the lock arm being formed with a guide space into which the rib is able to be inserted when the second housing is inserted into the inner space.

Since the electric connector in accordance with the present invention includes a rib extending in the above-mentioned first direction, it is possible to prevent the second housing from being deeply inserted in an inclined condition into the first housing when the second housing is inserted into the first housing. The lock arm of the second housing is formed with a guide space extending in the above-mentioned first direction to allow the rib of the first housing to enter, and hence, the rib of the first housing does not interfere with the second housing when the second housing is inserted into the first housing, ensuring that the second housing can be inserted in a correct posture into the first housing.

It is preferable that the guide space have a length shorter than a total length of the lock arm, the lock arm being divided by the guide space.

It is preferable that the guide space be defined as a groove formed at the lock arm.

It is preferable that the first housing be formed with a recess in which the lock arm is inserted, the rib being formed in the recess.

It is preferable that the rib be formed by at least a part of a total length of the inner space in a length-wise direction of the first housing.

It is preferable that the electric connector further include at least one second rib formed on a floor of the first housing, the second rib extending in the first direction, the second housing being formed with a recess into which the second rib is inserted.

It is preferable that the second rib be formed at a center in a width-wise direction of the first housing.

It is preferable that the second rib be formed by at least a part of a total length of the inner space in a length-wise direction of the first housing.

For instance, the lock arm may include a lock arm body extending in the first direction, the lock arm body being elastically deformable in a second direction perpendicular to the first direction, a first leg connecting the lock arm body at one of ends thereof to the second housing such that a gap is formed between the lock arm body and a surface of the second housing, a second leg connecting the lock arm body at the other end thereof to the second housing such that a gap is formed between the lock arm body and a surface of the second housing, and a wall obliquely extending from the lock arm body in a direction away from the surface of the second housing, wherein when the wall is pushed towards the lock arm body, the lock arm body is deformed with the first and second legs acting as fulcrums, then, the wall makes contact at a distal end thereof with the lock arm body, and then, the lock arm body is deformed with the first and second legs acting as fulcrums and further with an abutment point acting as a working point to thereby allow the lock projection to be released from the lock engagement portion of the first housing, the abutment point being defined as a point at which the wall and the lock arm body make contact with each other.

The wall is located at a rear of the lock projection of the lock arm supported at the first and second legs thereof on a surface of the second housing facing the lock engagement portion of the first housing, and is obliquely extending from the lock arm body towards the second leg. When the wall is pushed towards the lock arm body, the lock arm body is deformed with the first and second legs acting as fulcrums, then, the wall makes contact at a distal end thereof with the lock arm body, and then, the lock arm body is deformed with the first and second legs acting as fulcrums and further with the abutment point acting as a working point. Thus, the lock projection of the lock arm is able to much displace even if the wall is moved by a small distance, and accordingly, the lock projection can be released from the lock engagement portion of the first housing.

It is preferable that the second leg include third and fourth legs formed at opposite ends in a width-wise direction of the second leg, and at least one fifth leg formed between the third and fourth legs.

When the lock arm is deformed to thereby release the lock projection from the lock engagement portion of the first housing, the lock arm body can be prevented from being deformed at a rear end thereof at a center in a width-wise direction thereof, and hence, the lock projection can be caused to surely displace by a desired distance.

It is preferable that a gap between a distal end of the wall and the lock arm body be smaller than the gap between the lock arm body and the surface of the second housing.

The advantages obtained by the above-mentioned present invention will be described hereinbelow.

Firstly, the first housing is formed therein with a rib extending in a direction in which the second housing is inserted into the first housing, and the lock arm is formed with a guide space into which the rib is insertable when the second housing is inserted into the first housing. Consequently, it is possible to prevent the second housing from being inserted in an inclined condition into the first housing, and further, it is also possible to prevent the second housing from contacting and bending metallic terminals even if the metallic terminals extend in the first housing.

Secondly, the lock arm is designed to include a lock arm body extending in the first direction, the lock arm body being elastically deformable in a second direction perpendicular to the first direction, a first leg connecting the lock arm body at one of ends thereof to the second housing such that a gap is formed between the lock arm body and a surface of the second housing, a second leg connecting the lock arm body at the other end thereof to the second housing such that a gap is formed between the lock arm body and a surface of the second housing, and a wall obliquely extending from the lock arm body in a direction away from the surface of the second housing, wherein when the wall is pushed towards the lock arm body, the lock arm body is deformed with the first and second legs acting as fulcrums, then, the wall makes contact at a distal end thereof with the lock arm body, and then, the lock arm body is deformed with the first and second legs acting as fulcrums and further with an abutment point acting as a working point to thereby allow the lock projection to be released from the lock engagement portion of the first housing, the abutment point being defined as a point at which the wall and the lock arm body make contact with each other.

By designing the lock arm to have the above-mentioned structure, it is possible to release the lock projection from the lock engagement portion by causing the wall to displace only by a small distance, enabling to fabricate an electric connector in a reduced height.

Thirdly, the lock arm is supported by the second leg on a surface of the second housing, the surface facing the lock engagement portion of the first housing, the second leg including third and fourth legs formed at opposite ends in a width-wise direction of the second leg, and at least one fifth leg formed between the third and fourth legs.

By designing the second leg to have the above-mentioned structure, it is possible to prevent the lock arm body from being deformed at a rear end thereof at a center in a width-wise direction thereof, and hence, the lock projection of the lock arm can be caused to displace by a desired distance. Thus, it is possible to surely release the lock projection from the lock engagement portion by causing the wall to displace only by a small distance.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

Figure 1:
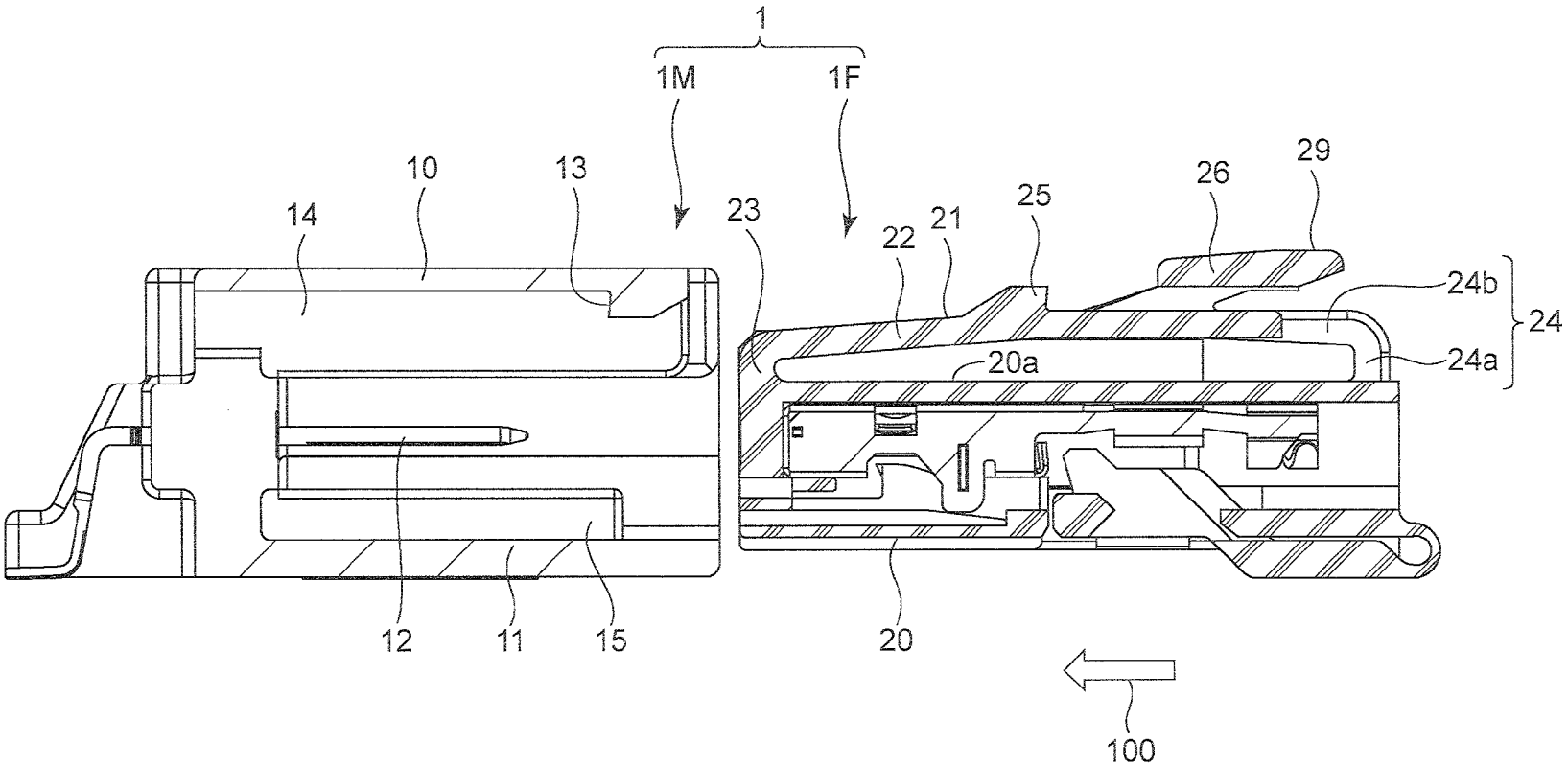
FIG. 1 is a cross-sectional view of an electric connector in accordance with a preferred embodiment of the present invention.
Figure 2:
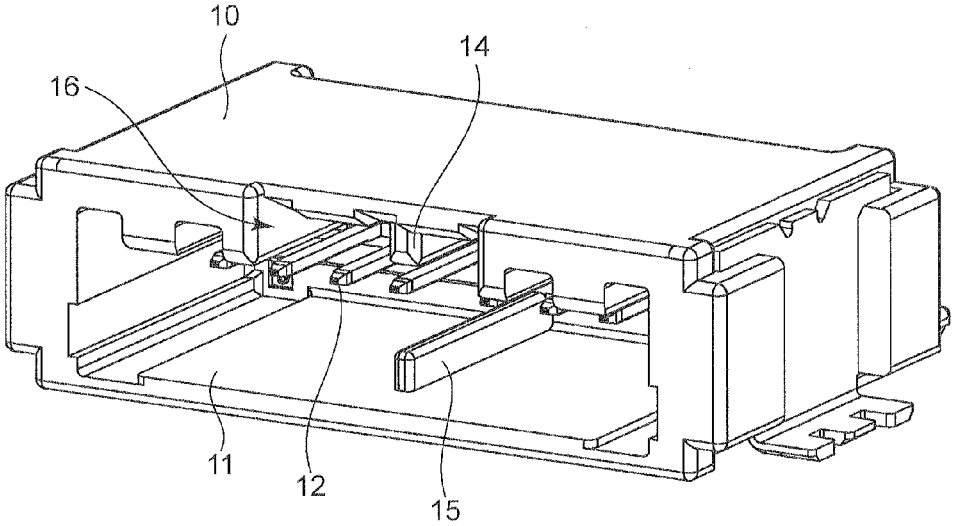
FIG. 2 is a perspective view of an outer housing illustrated in FIG. 1.
Figure 3:
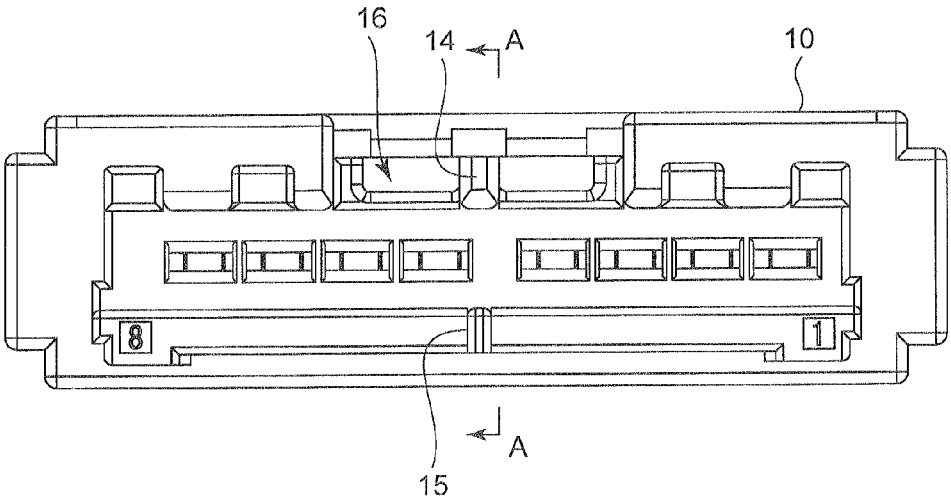
FIG. 3 is a front view of the outer housing illustrated in FIG. 2.
Figure 4:
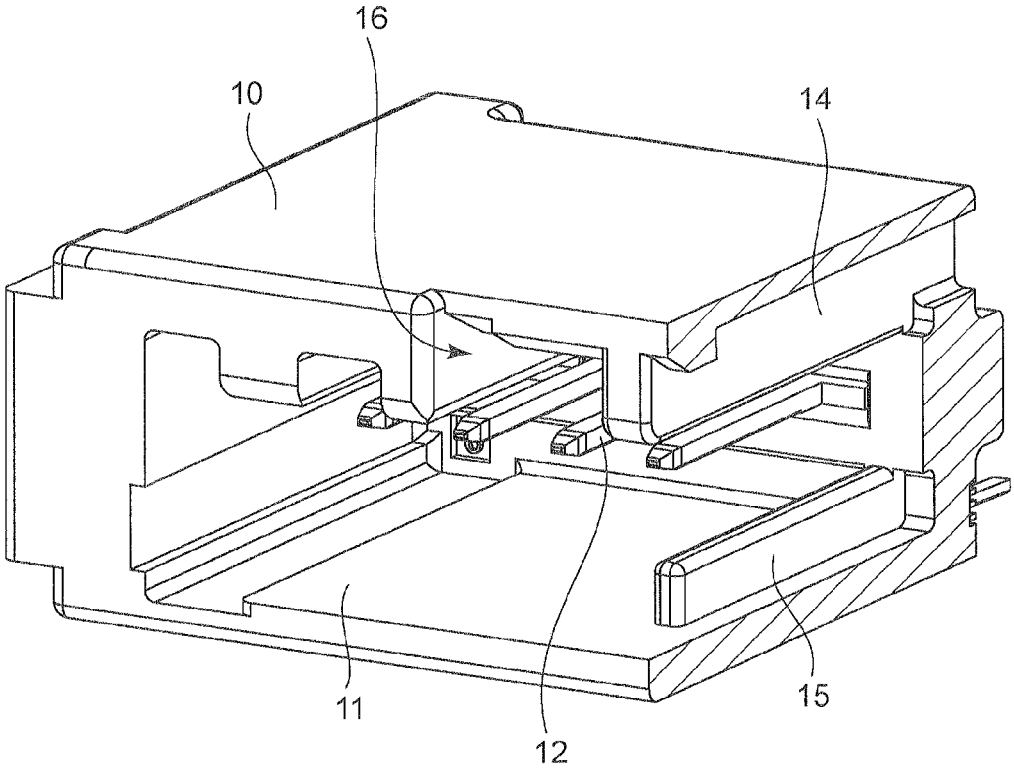
FIG. 4 is a perspective cross-sectional view taken along line A-A in FIG. 3.
Figure 5:
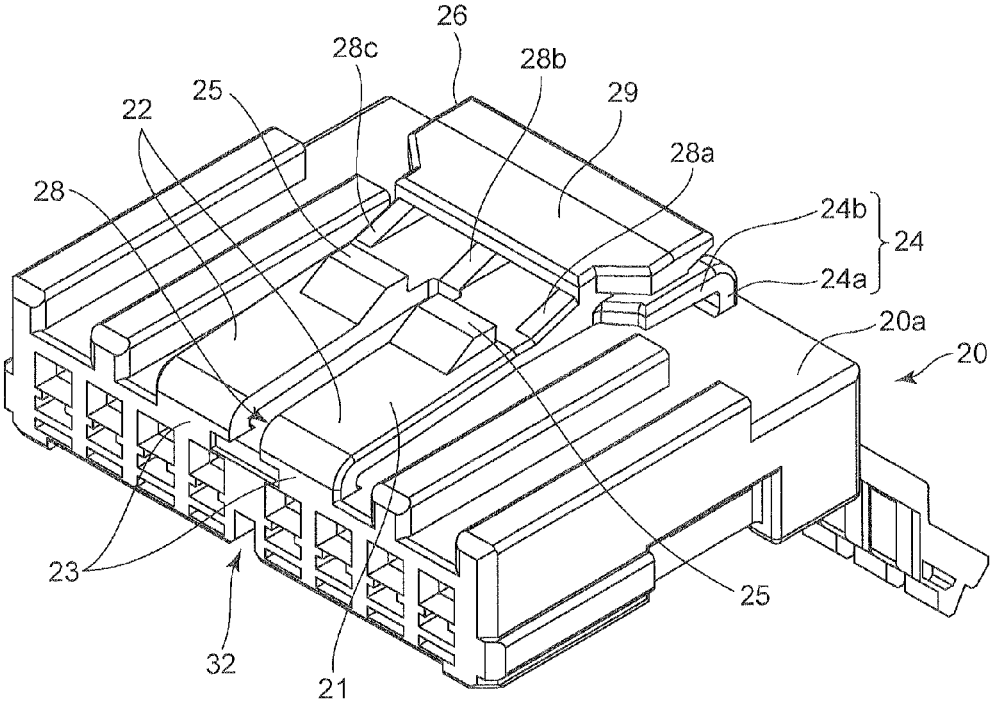
FIG. 5 is a perspective view of an inner housing illustrated in FIG. 1.
Figure 6:
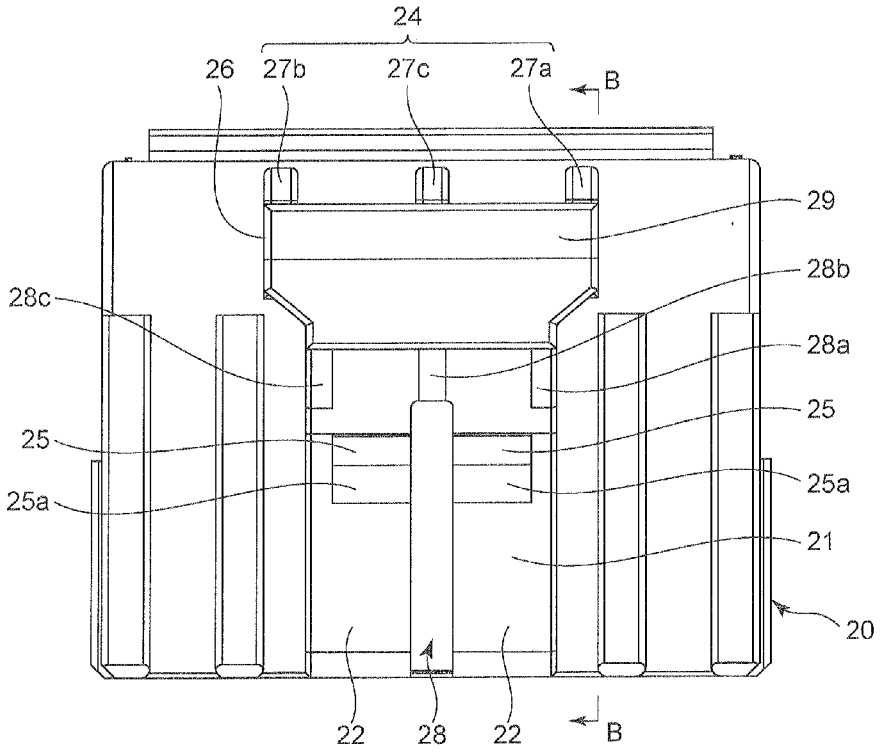
FIG. 6 is a plan view of the inner housing illustrated in FIG. 5.
Figure 7:
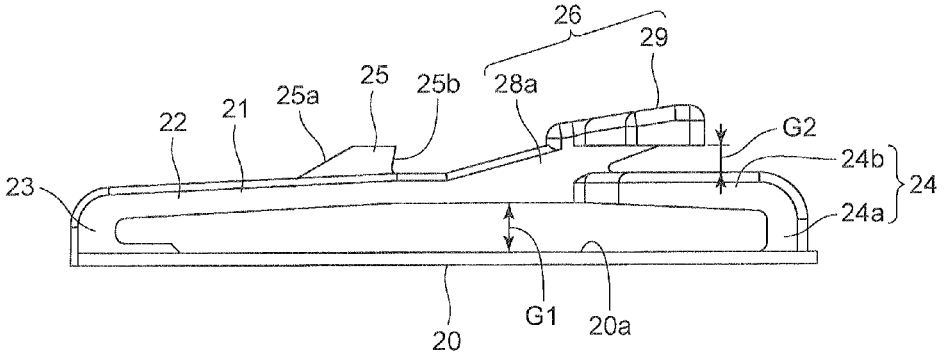
FIG. 7 is a right-side view of a lock arm of the inner housing.
Figure 8:
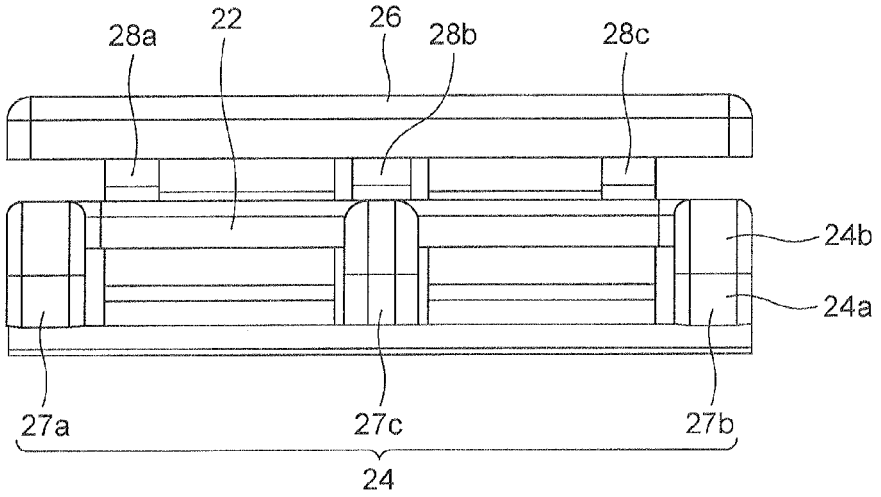
FIG. 8 is a rear view of the lock arm illustrated in FIG. 7.
Figure 10A:
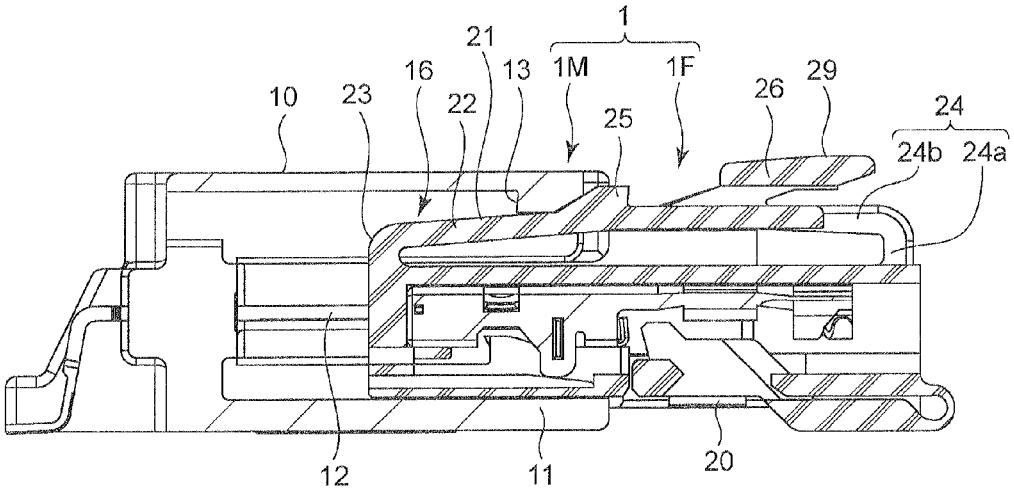
FIG. 10A is a cross-sectional view of male and female connectors which are being coupled to each other.
Figure 10B:
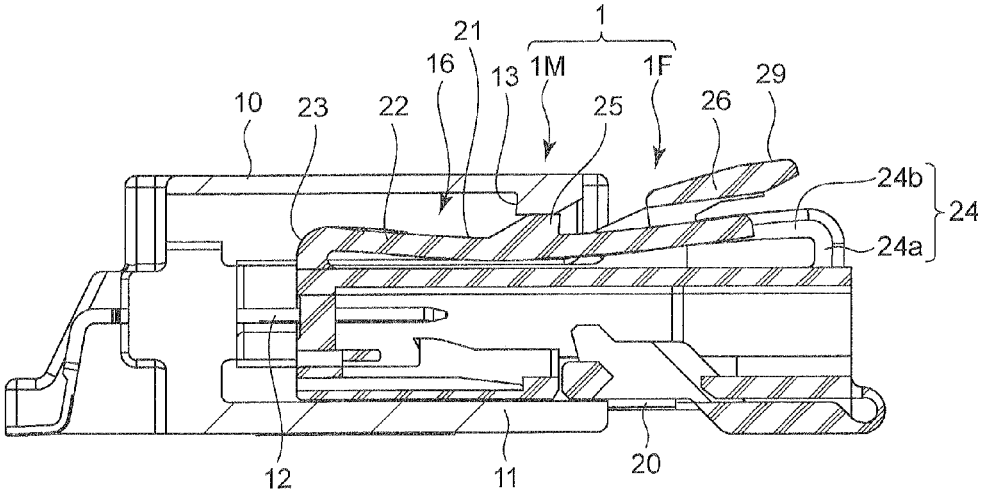
FIG. 10B is a cross-sectional view of the male and female connectors which are being coupled to each other.
Figure 10C:
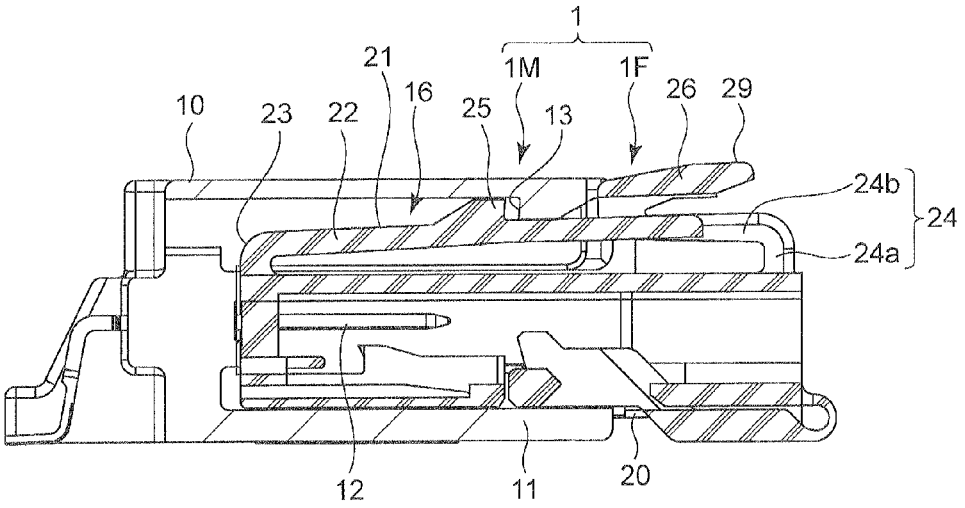
FIG. 10C is a cross-sectional view of the male and female connectors coupled to each other.

FIG. 1 is a cross-sectional view of an electric connector in accordance with a preferred embodiment of the present invention, FIG. 2 is a perspective view of an outer housing illustrated in FIG. 1, FIG. 3 is a front view of the outer housing illustrated in FIG. 2, FIG. 4 is a perspective cross-sectional view taken along line A-A in FIG. 3, FIG. 5 is a perspective view of an inner housing illustrated in FIG. 1, FIG. 6 is a plan view of the inner housing illustrated in FIG. 5, FIG. 7 is a right-side view of a lock arm of the inner housing, and FIG. 8 is a rear view of the lock arm illustrated in FIG. 7. FIG. 1 and later-mentioned FIGS. 10A to 10C illustrate a cross-section of the electric connector taken along line B-B in FIG. 6.

In FIG. 1, an electric connector 1 in accordance with the preferred embodiment includes a male connector 1M and a female connector 1F to be fit into the male connector 1M.

The male connector 1M includes an outer housing 10 as a male housing, and a plurality of male metal terminals 12. The outer housing 10 includes a hood 11 having a rectangular cross-section and being open towards the female connector 1F. In the hood 11, the male metal terminals 12 protrude towards the female connector 1F. The hood 11 is formed with a lock engagement portion 13 on an inner surface of a top wall at an end closer to the female connector 1F. The lock engagement portion 13 downwardly protrudes into the hood 11 at a center in a width-wise direction (a direction perpendicular to a plane defined by FIG. 1) of the outer housing 10.

As illustrated in FIGS. 2 to 4, a first rib 14 and a second rib 15 are formed in the hood 11. The first rib 14 is formed on an inner surface of a top wall of the outer housing 10, and extends in a direction 100 (see FIG. 1) in which the female connector 1F is fit into the male connector 1M.

The hood 11 includes at an inner surface of a top wall thereof and at a center in a width-wise direction of the outer housing 10 a recess 16 acting as a guide space having a shape corresponding to a later-mentioned lock arm 21 of a later-mentioned inner housing 20 so as to allow the lock arm 21 to be inserted thereinto. The lock engagement portion 13 and the first rib 14 are formed in the recess 16. The first rib 14 is located at a center of the recess 16 in a width-wise direction of the outer housing 10.

The second rib 15 is formed on a floor of the hood 11 at a center of the recess 16 in a width-wise direction of the outer housing 10. That is, the second rib 15 is located just below the first rib 14.

The female connector 1F includes the inner housing 20 (see FIGS. 5 and 6) having a rectangular cross-section, as a female housing, and a plurality of female metal terminals (not illustrated) housed in the inner housing 20 and to be electrically connected with the male metal terminals 12 of the male connector 1M. The inner housing 20 is fit into the hood 11 of the outer housing 10.

In the specification, a wording "front" refers to a front (on a left-side in FIG. 1) in the direction 100, and a wording "rear" refers to a rear (on a right-side in FIG. 1) in the direction 100.

As illustrated in FIGS. 1 and 5, the inner housing 20 is integrally formed with a lock arm 21 on an upper surface 20*a* (a surface facing the lock engagement portion 13 of the outer housing 10) thereof. As illustrated in FIG. 7, the lock arm 21 includes a lock arm body 22 in the form of a plate extending in a length-wise direction of the inner housing 20, a front leg 23 supporting a front edge of the lock arm body 22 on the upper surface 20*a* of the inner housing 20, a rear leg 24 supporting a rear edge of the lock arm body 22 on the upper surface 20*a* of the inner housing 20, a lock projection 25 to be locked with the lock engagement portion 13 of the outer housing 10 when the inner housing 20 is fit into the hood 11, and a lock-releasing unit 26 for releasing the lock projection 25 from the lock engagement portion 13 of the outer housing 10.

The lock arm body 22, the front leg 23, the rear leg 24, the lock projection 25, and the lock-releasing unit 26 are integrally formed with the inner housing 20.

The lock arm body 22 is supported by the front and rear legs 23 and 24 above the upper surface 20*a* of the inner housing 20 such that there exists a gap G1 between the lock arm body 22 and the upper surface 20*a* of the inner housing 20. The lock projection 25 upwardly protrudes from the lock arm body 22 between the front leg 23 and the lock-releasing unit 26. The lock projection 25 has an inclining front surface 25*a* obliquely and backwardly extending from an upper surface of the lock arm body 22, and a rear surface 25*b* vertically standing on the upper surface of the lock arm body 22. The lock-releasing unit 26 is located at a rear of the lock projection 25, and obliquely extends in a direction away from the inner housing 20. Specifically, the lock-releasing unit 26 obliquely extends backwardly, that is, towards the rear leg 24.

The front leg 23 protrudes downwardly from the front edge of the lock arm body 22. The front leg 23 is connected at a lower end thereof with the upper surface 20*a* of the inner housing 20 at a front end of the inner housing 20. The lock arm body 22 upwardly inclines between the front leg 23 and the lock projection 25, and extends in parallel with the upper surface 20*a* of the inner housing 20 between the lock projection 25 and the rear leg 24.

As illustrated in FIG. 5, the lock arm body 22 and the front leg 23 are formed with a guide space 28 at a center in a width-wise direction of the inner housing 20. The guide space 28 guides and allows the first rib 14 to be inserted thereinto when the inner housing 20 is inserted into the hood 11 of the outer housing 10. The guide space 28 is shaped to receive the first rib 14 therein, and extends from a front of the inner housing 20 beyond the lock projection 25. The lock arm 21 is divided into two portions by the guide space 28 in an area where the guide space 28 exists.

As illustrated in FIG. 5, the inner housing 20 is formed at a lower surface thereof with a guide recess 32 shaped to receive the second rib 15 therein to allow the second rib 15 to enter when the inner housing 20 is fit into the hood 11 of the outer housing 10.

The rear leg 24 includes a standing portion 24*a* vertically standing at a rear end of the inner housing 20 on the upper surface 20*a* of the inner housing 20, and an extended portion 24*b* horizontally forwardly extending from an upper end of the standing portion 24*a*.

As illustrated in FIG. 8, the rear leg 24 in the present embodiment includes a left leg 27*a* and a right leg 27*b* situated at opposite ends in a width-wise direction of the rear leg 24, and an intermediate leg 27*c* situated between the left leg 27*a* and the right leg 27*b*. Each of the left leg 27*a*, the right leg 27*b* and the intermediate leg 27*c* is comprised of the above-mentioned standing portion 24*a* and extended portion 24*b*.

The lock arm body 22 is supported at a front end thereof by the front leg 23 on the inner housing 20, and at a rear end thereof by the standing portion 24*a* of the rear leg 24 on the inner housing 20, and is elastically deformable vertically, that is, in a direction perpendicular to the upper surface 20*a* of the inner housing 20 with the front leg 23 and the standing portion 24*a* both acting as fulcrums. Not only the lock arm body 22, but also the extended portion 24*b* of the rear leg 24 can be elastically deformed.

The lock-releasing unit 26 includes walls 28*a*, 28*b* and 28*c* (see FIG. 5) extending obliquely and backwardly from the upper surface of the lock arm body 22, and a finger contact 29 in the form of a horizontal plate connecting upper ends of the walls 28*a*, 28*b* and 28*c* to each other. The finger contact 29 of the lock-releasing unit 26 is located above the extended portion 24*b* of the rear leg 24 with a gap G2 therebetween (see FIG. 7).

Figure 11A:
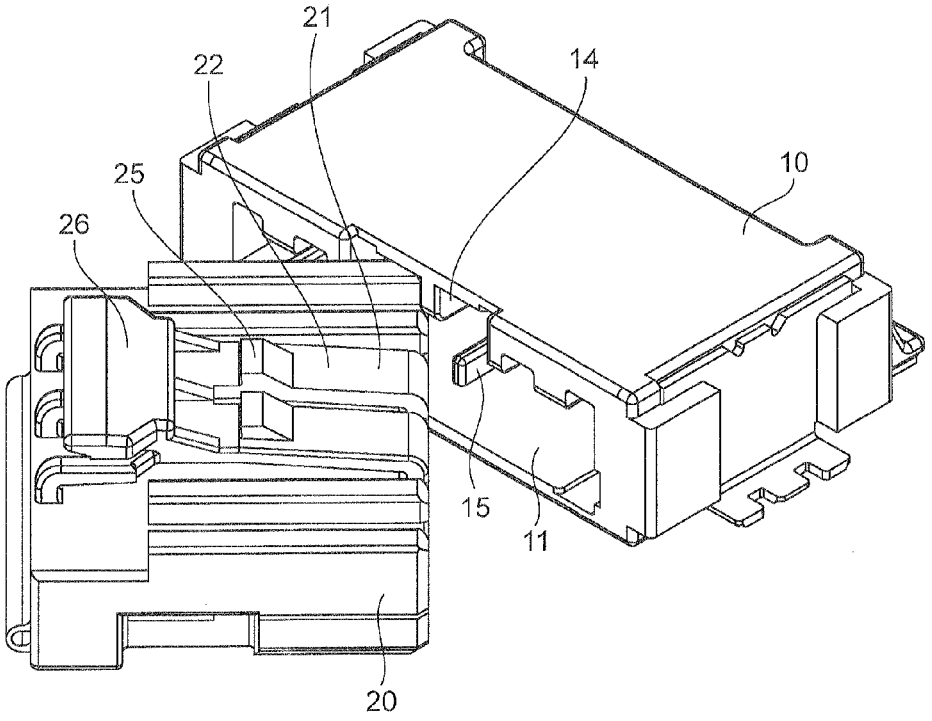
FIG. 11A is a perspective view illustrating that the inner housing is attempted to be inserted in an inclined condition into the outer housing.
Figure 11B:
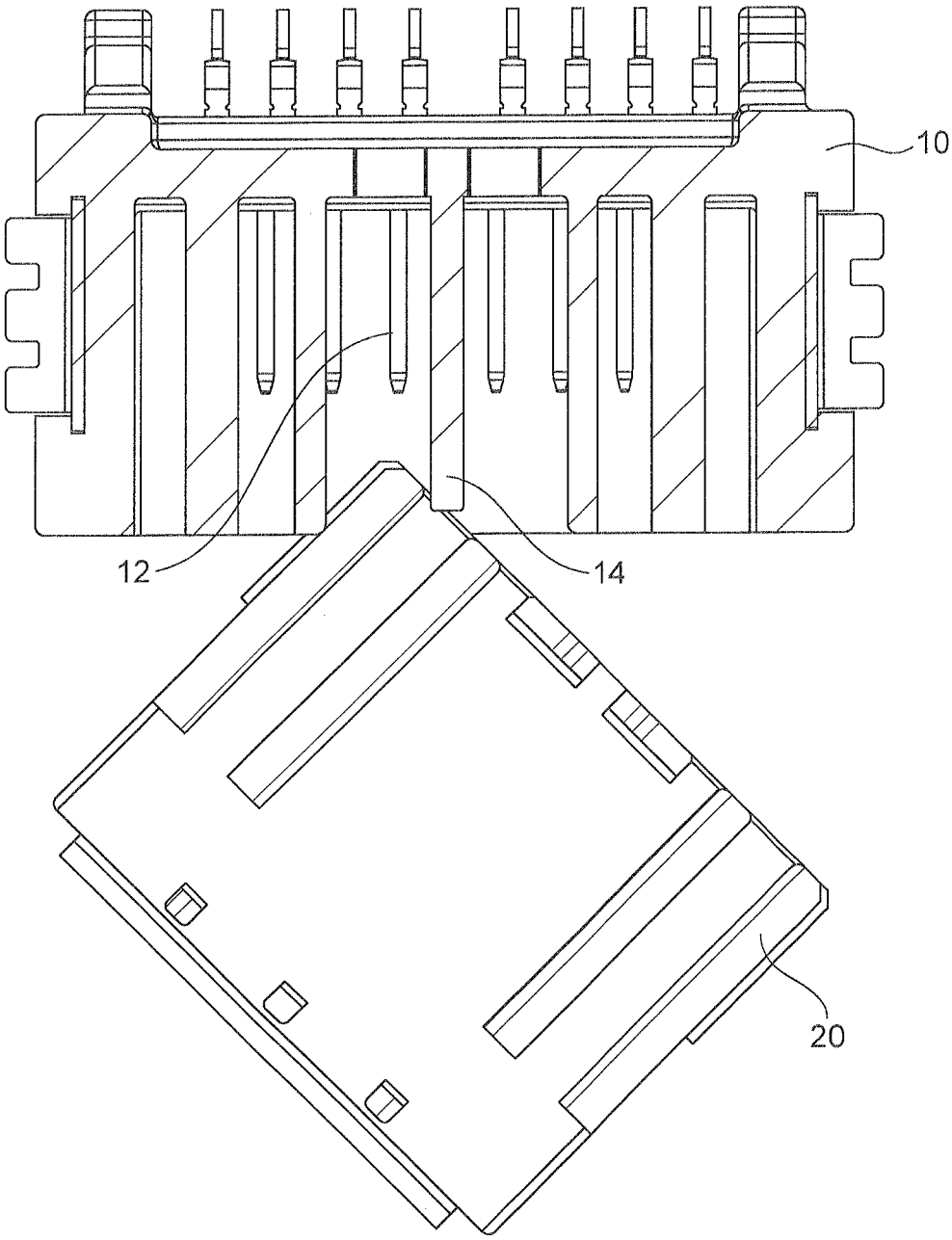
FIG. 11B is a cross-sectional view illustrating that the inner housing is attempted to be inserted in an inclined condition into the outer housing.

As illustrated in FIG. 10A, the female connector 1F is fit into the male connector 1M in the electric connector 1 having the above-mentioned structure by inserting the inner housing 20 into the hood 11 through a rear of the outer housing 10. As illustrated in FIGS. 11A and 11B, even if the inner housing 20 is attempted to be inserted in an inclined condition into the outer housing 10, the first rib 14 formed in the hood 11 of the outer housing 10 prevents the inner housing 20 from being inserted in an inclined condition deeply into the outer housing 10. Thus, it is possible to prevent the inner housing 20 from abutting and bending the male metal terminals 12 housed in the outer housing 10.

The second rib 15 acts in the same way as the first rib 14. Specifically, the second rib 15 formed in the hood 11 of the outer housing 10 prevents the inner housing 20 from being inserted in an inclined condition deeply into the outer housing 10, to thereby prevent the inner housing 20 from abutting and bending the male metal terminals 12 housed in the outer housing 10.

In the case of the inner housing 20 inserted in a correct posture into the outer housing 10, since the first rib 14 and the second rib 15 formed in the outer housing 10 are inserted into the guide space 28 and the guide recess 32, respectively, the first rib 14 and the second rib 15 do not interfere with the inner housing 20. Thus, it is ensured that the inner housing 20 is inserted in a correct posture into the outer housing 10.

When the female connector 1F is fit into the male connector 1M, as illustrated in FIG. 10A, the inner housing 20 is fit into the hood 11 through the rear of the outer housing 10. When the lock projection 25 of the inner housing 20 abuts on the lock engagement portion 13 of the outer housing 10 to push the lock projection 25, the lock arm body 22 is elastically downwardly deformed at a central portion thereof, as illustrated in FIG. 10B, and hence, the lock projection 25 of the inner housing 20 is lowered beyond the lock engagement portion 13 of the outer housing 10. When the lock projection 25 passes over the lock engagement portion 13, the lock arm body 22 recovers into its original shape illustrated in FIG. 10A, and accordingly, the lock projection 25 of the inner housing 20 is engaged or locked with the lock engagement portion 13 of the outer housing 10, as illustrated in FIG. 10C.

Figure 12A:
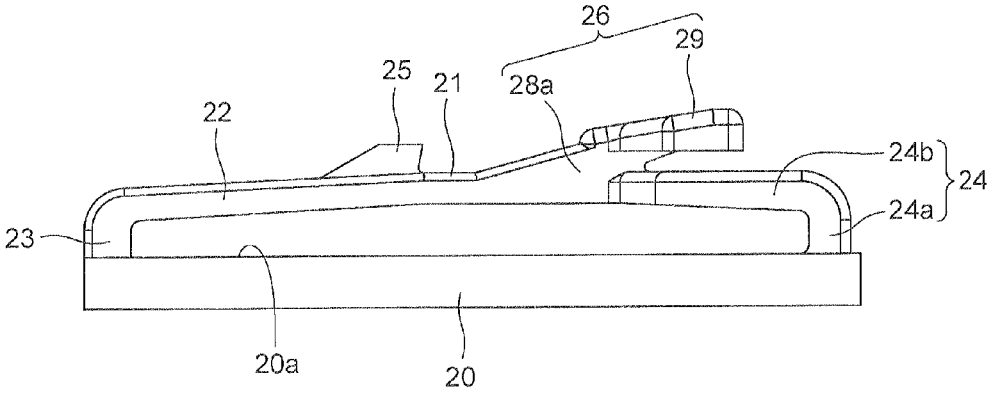
FIG. 12A is a right-side view of the lock arm when the male and female connectors are coupled to each other.
Figure 12B:
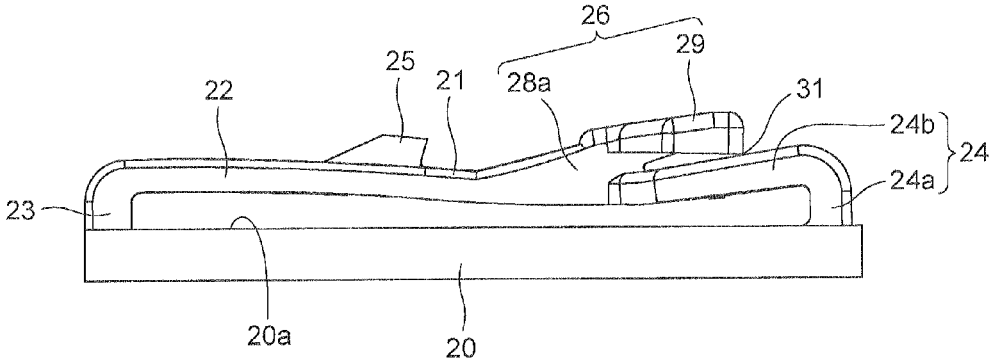
FIG. 12B is a right-side view of the lock arm at a first push-down stage.

When the female connector 1F is released from the male connector 1M, the finger contact 29 is pushed downwardly. As a result, the lock arm body 22 is deformed from its initial posture illustrated in FIG. 12A to a posture illustrated in FIG. 12B. Specifically, the front leg 23 and the standing portion 24*a* of the rear leg 24 both act as fulcrums to thereby cause the lock arm body 22 to be deformed, and thus, as illustrated in FIG. 12B, the finger contact 29 makes contact at a lower surface thereof with the extended portion 24*b* of the rear leg 24 (the first push-down stage). The finger contact 29 makes contact with the extended portion 24*b* at an abutment point 31.

Figure 12C:
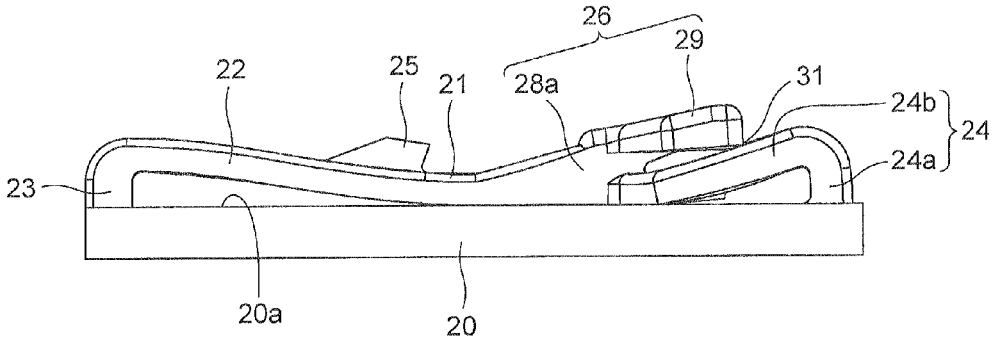
FIG. 12C is a right-side view of the lock arm at a second push-down stage.

Then, as illustrated in FIG. 12C, the lock arm body 22 is deformed with the front leg 23 and the standing portion 24*a* both acting as fulcrums and further with the abutment point 31 acting as a working point (the second push-down stage). Thus, the lock projection 25 is released from the lock engagement portion 13 of the outer housing 10. While the lock projection 25 is kept released from the lock engagement portion 13 the female connector 1F is pulled out of the male connector 1M.

As explained so far, the lock arm body 22 is deformed first at the first push-down stage, and then, at the second push-down stage. Specifically, the lock arm body 22 is deformed in such a way that the front leg 23 and the standing portion 24*a* of the rear leg 24 both act as fulcrums at the first push-down stage, and then, further deformed in such a way that the front leg 23 and the standing portion 24*a* both act as fulcrums and further the abutment point 31 acts as a working point at the second push-down stage. Thus, the lock projection 25 can displace by a longer distance, by virtue of even a smaller distance of the lock-releasing unit 26 in comparison with the conventional lock arm 51 illustrated in FIG. 13, ensuring that the lock projection 25 can be surely released from the lock engagement portion 13 of the outer housing 10. Since the lock projection 25 can be released from the lock engagement portion 13 with a small displacement of the lock-releasing unit 26, it is possible to design the electric connector 1 reduced in height.

Figure 13:
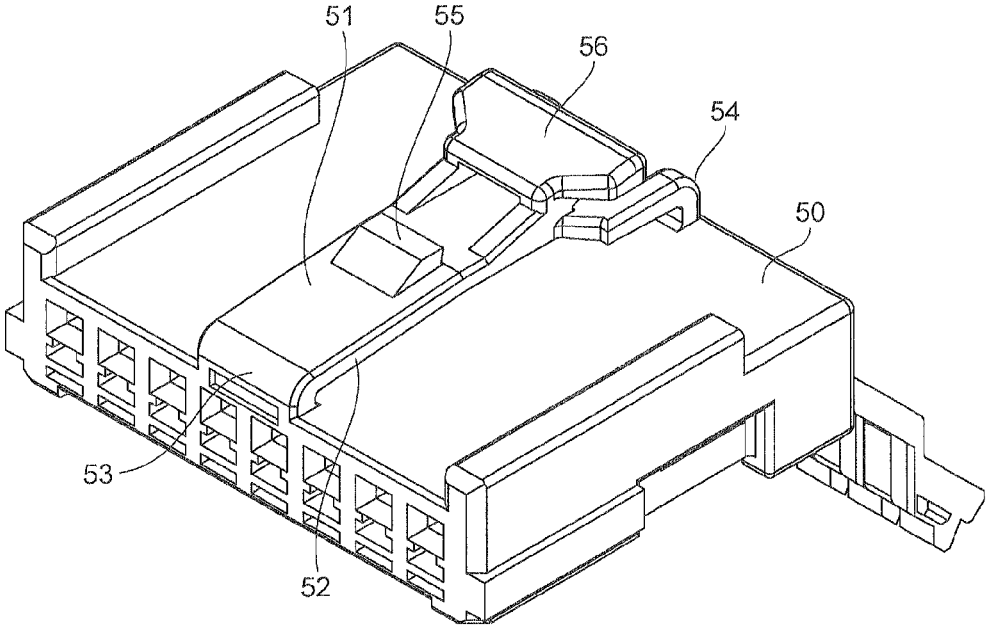
FIG. 13 PRIOR ART
FIG. 13 is a perspective view illustrating an example of an inner housing of a conventional electric connector including a lock arm.
Figure 14:
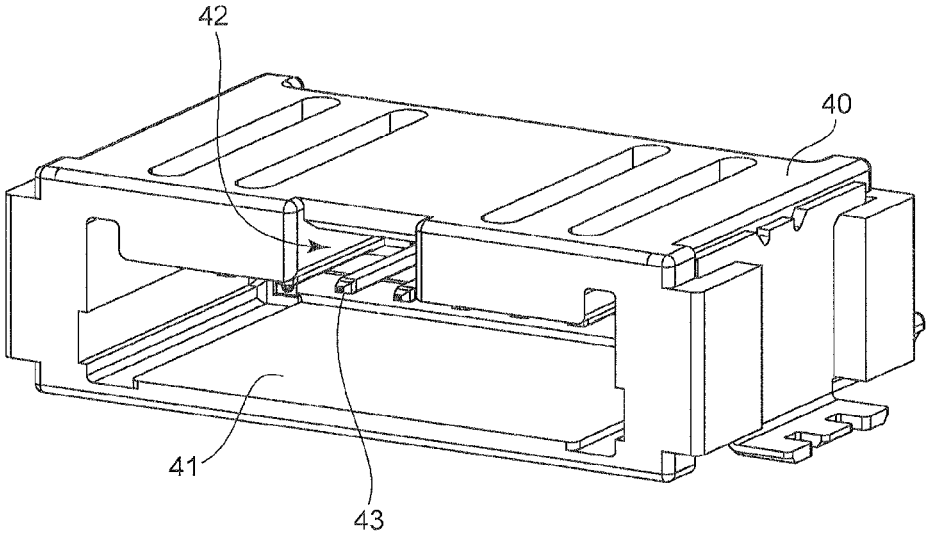
FIG. 14 PRIOR ART
FIG. 14 is a perspective view illustrating an example of an outer housing of the conventional electric connector including the lock arm.
Figure 15:
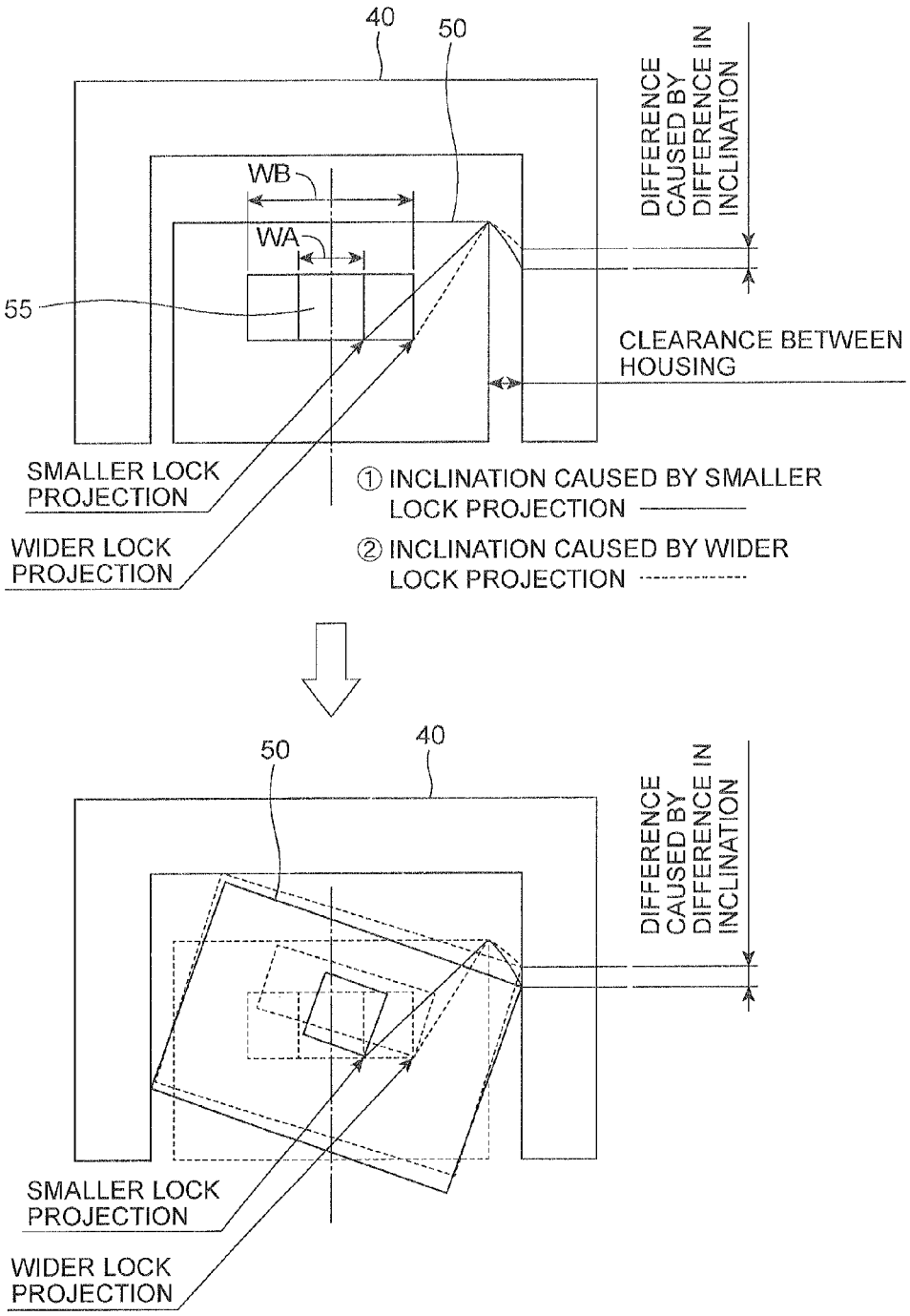
FIG. 15 is an illustration explaining a difference in inclination of an inner housing, the difference being caused by a difference between widths of lock projections.
Figure 16:
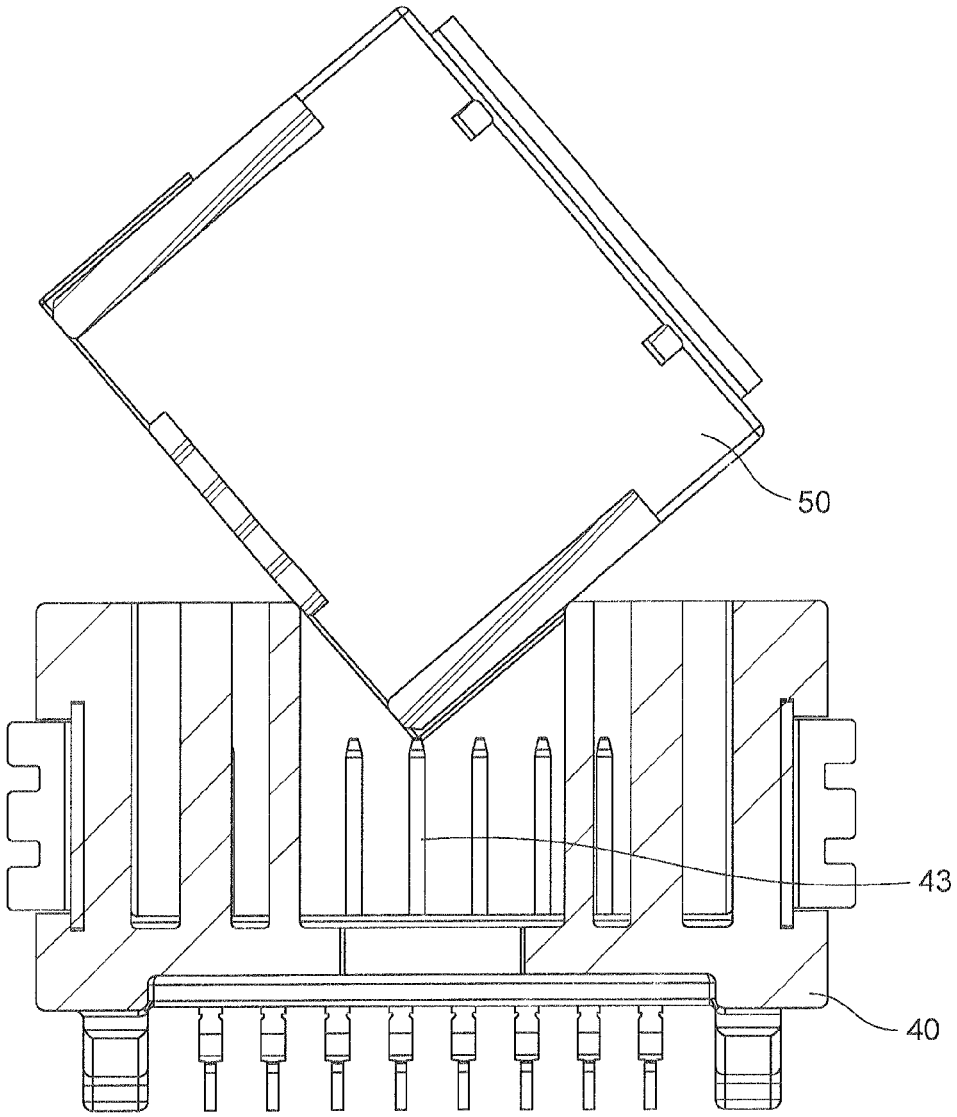
FIG. 16 is a cross-sectional view illustrating that the inner housing is attempted to be inserted in an inclined condition into the outer housing.
Figure 17A:
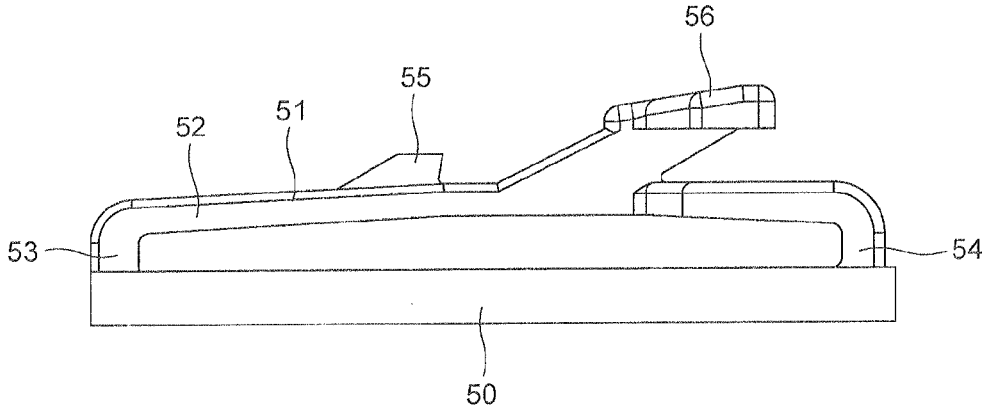
FIG. 17A PRIOR ART
FIG. 17A is a right-side view of a conventional lock arm.
Figure 17B:
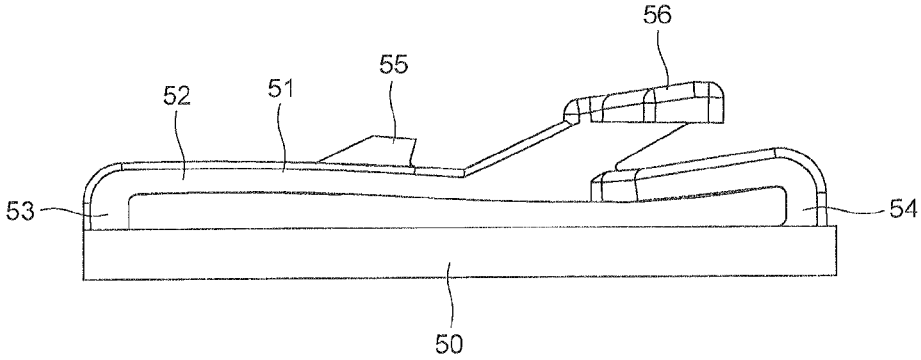
FIG. 17B PRIOR ART
FIG. 17B is a right-side view of the conventional lock arm being pushed downwardly.
Figure 17C:
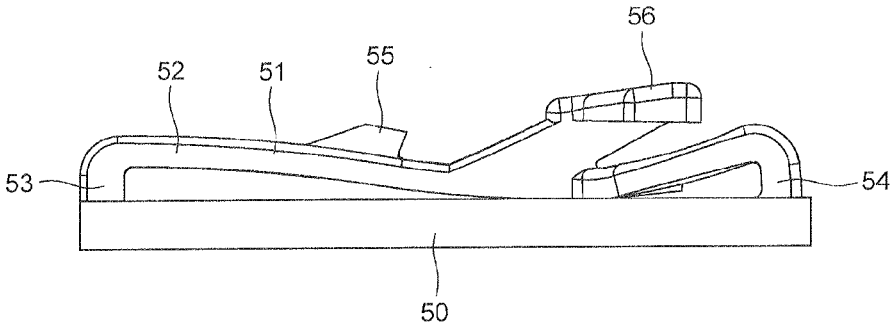
FIG. 17C PRIOR ART
FIG. 17C is a right-side view of the conventional lock arm having been pushed downwardly.

In a conventional lock arm 51 illustrated in FIGS. 13 and 17A, a lock-releasing unit 56 is pushed downwardly to release a lock projection 55 from a lock engagement portion. Thus, as illustrated in FIG. 17B, a lock arm body 52 is deformed with a front leg 53 and a rear leg 54 both acting as fulcrums. As illustrated in FIG. 17C, the lock arm body 52 is deformed until the lock arm body 52 makes contact at a lower surface thereof with an upper surface of an inner housing 50, resulting in that the lock projection 55 is released from the lock engagement portion of the outer housing 16.

In the conventional lock arm 51, since the lock arm body 52 is deformed only by a force exerted on the lock-releasing unit 56, it is necessary to cause the lock-releasing unit 56 to much move downwardly for allowing the lock projection 55 to be released from the lock engagement portion of the outer housing. Accordingly, the conventional lock arm 51 is accompanied with a problem in that a large space is required between the lower surface of the lock arm body 52 and the upper surface of the inner housing 50, and hence, the electric connector including the conventional lock arm 51 is unavoidably high in height.

In contrast, the lock arm 21 in the present embodiment allows the lock projection 55 to be released from the lock engagement portion 55 by virtue of a small displacement of the lock-releasing unit 26, enabling the electric connector 1 smaller in height than the conventional electric connector.

The rear leg 24 is supported on the upper surface 20*a* of the inner housing 20 by the left leg 27*a*, the right leg 27*b* and the intermediate leg 27*c*. This prevents the lock arm body 22 from being deformed at a rear end thereof at a central portion in a width-wise direction of the lock arm body 22 when the lock arm body 22 is deformed in such a way that the front leg 23 and the standing portion 24*a* both act as fulcrums and further the abutment point 31 acts as a working point at the second push-down stage. Accordingly, it is possible to surely make the lock projection 25 displace to thereby release the lock projection 25 from the lock engagement portion 13 by virtue of a small displacement of the lock-releasing unit 26.

Figure 9:
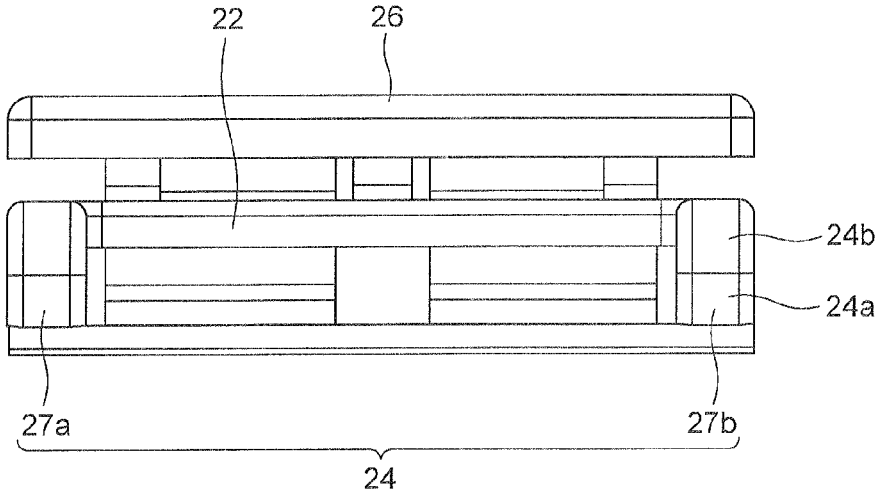
FIG. 9 is a rear view of a lock arm in accordance with a variation.

The intermediate leg 27*c* is preferably at a center between the left leg 27*a* and the right leg 27*b*. It should be noted that the intermediate portion 27*c* may be situated at any location between the left leg 27*a* and the right leg 27*b*. The lock arm 21 may include a plurality of the intermediate legs 27*c* between the left leg 27*a* and the right leg 27*b*. As an alternative, the lock arm 21 may be designed not to include the intermediate leg 27*c*, as illustrated in FIG. 9.

The lock projection 25 may not be a projection. The lock projection 25 may be any recess that can be engaged with the lock engagement portion 13 of the outer housing 10.

It is preferable that the gap G2 (see FIG. 7) between distal ends of the walls 28*a*, 28*b* and the lock arm body 22 or between the finger contact 29 and the extended portion 24*b* of the rear leg 24 be smaller than the gap G1 (see FIG. 7) between the lock arm body 22 and the surface 20*a* of the second housing 20. The gap G2 designed to be smaller than the gap G1 may facilitate the lock arm body 22 to be deformed first at the first push-down stage, and then, at the second push-down stage.

As illustrated in FIG. 1, the rib 14 is designed to have a length almost equal to a total length of the inner space of the hood 11 in a length-wise direction of the outer housing 10. As an alternative, the rib 14 may be formed by at least a part of a total length of the inner space. For instance, the rib 14 may have a short length only at an opening of the inner space.

As illustrated in FIG. 1, the second rib 15 is designed to have a length starting at a distance from an opening of the outer housing 10. Similarly to the first rib 14, the second rib 15 may be designed to have a length equal to a total length of the inner space, or may be formed at least partially in a length-wise direction of the inner space of the outer housing 10.

INDUSTRIAL APPLICABILITY

The electric connector in accordance with the present invention is suitable to an electric connector used for accomplishing electrical connection between devices equipped in an automobile and/or an industrial machine and so on.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-091516 filed on Apr. 25, 2014 including specification, claims, drawings and summary is incorporated herein by reference in its entirety.

What is claimed is:

1. An electric connector including:

a first connector including a first housing in which an inner space is formed; and a second connector including a second housing insertable into said inner space, said first housing including in said inner space a lock engagement portion, said second housing including a lock arm having a lock projection to be engaged with said lock engagement portion, said first housing including in said inner space at least one rib extending in a first direction in which said second housing is inserted into said inner space, said lock arm being formed with a guide space into which said rib is able to be inserted when said second housing is inserted into said inner space said lock arm including a lock arm body extending in said first direction, said lock arm body being elastically deformable in a second direction perpendicular to said first direction, a first leg connecting said lock arm body at one of ends thereof to said second housing such that a gap is formed between said lock arm body and a surface of said second housing, a second leg connecting said lock arm body at the other end thereof to said second housing such that a gap is formed between said lock arm body and a surface of said second housing, and an elastic arm obliquely extending from said lock arm body in a direction away from said surface of said second housing, wherein when said arm is pushed towards said lock arm body, said lock arm body is deformed with said first and second legs acting as fulcrums, then, said arm makes contact at a distal end thereof with said lock arm body, and then, said lock arm body is deformed with said first and second legs acting as fulcrums and further with an abutment point acting as a working point to thereby allow said lock projection to be released from said lock engagement portion of said first housing, said abutment point being defined as a point at which said arm and said lock arm body make contact with each other.

2. The electric connector as set forth in claim 1, wherein said guide space has a length shorter than a total length of said lock arm, said lock arm being divided by said guide space.

3. The electric connector as set forth in claim 1, wherein said guide space is defined as a groove formed at said lock arm.

4. The electric connector as set forth in claim 1, wherein said first housing is formed with a recess in which said lock arm is inserted, said rib being formed in said recess.

5. The electric connector as set forth in claim 1, wherein said rib is formed by at least a part of a total length of said inner space in a length-wise direction of said first housing.

6. The electric connector as set forth in claim 1, further including at least one second rib formed on a floor of said first housing, said second rib extending in said first direction, said second housing being formed with a recess into which said second rib is inserted.

7. The electric connector as set forth in claim 6, wherein said second rib is formed at a center in a width-wise direction of said first housing.

8. The electric connector as set forth in claim 6, wherein said second rib is formed by at least a part of a total length of said inner space in a length-wise direction of said first housing.

9. The electric connector as set forth in claim 1, wherein said second leg includes:

third and fourth legs formed at opposite ends in a width-wise direction of said second leg; and at least one fifth leg formed between said third and fourth legs.

10. The electric connector as set forth in claim 1, wherein a gap between a distal end of said wall and said lock arm body is smaller than said gap between said lock arm body and said surface of said second housing.

* * * * *